United States Patent [19]

Varda

[11] 3,957,307

[45] May 18, 1976

[54] ROUGH CUTTER MINING TOOL

[76] Inventor: Olind Varda, 23325 Blackstone, Warren, Mich. 48089

[22] Filed: Sept. 18, 1974

[21] Appl. No.: 507,007

[52] U.S. Cl. ..... 299/86

[51] Int. Cl.[2] ..... E21L 35/18

[58] Field of Search ..... 299/86, 92; 308/8.2; 85/8.8; 175/354

[56] References Cited

UNITED STATES PATENTS

| | | | |
|---|---|---|---|
| 3,093,025 | 6/1963 | Wasserman | 85/8.8 |
| 3,397,013 | 8/1968 | Krekeler | 299/86 |
| 3,499,685 | 3/1970 | Knift | 299/86 |
| 3,652,130 | 3/1972 | Elders | 299/86 |
| 3,663,063 | 5/1972 | Johnmeyer, Sr. | 299/86 |
| 3,833,264 | 9/1974 | Elders | 299/86 |
| 3,833,265 | 9/1974 | Elder | 299/86 |

*Primary Examiner*—Ernest R. Purser
*Assistant Examiner*—William F. Pate, III
*Attorney, Agent, or Firm*—Cullen, Settle, Sloman & Cantor

[57] ABSTRACT

A rough cutter rotary mining tool formed of a support lug having an elongated, open ended, cylindrical bore and a cutter bit having a cylindrical shank portion extending through and loosely fitted within the bore, with the cutter head portion extending a distance beyond the forward end of the bore. An integral shoulder portion is arranged between the head and shank portions for engaging the lug at the forward end of the bore and a removable retaining clip is mounted upon the free end of the shank portion for engaging the rear end of the lug at the bore. The shank portion is loosely movable endwise a short distance relative to the bore. Also, the diameter of the shank portion is considerably smaller than the bore portion to form a space therebetween and so that the shank may easily rotate within and move transversely of the bore. Thus, small sand-like particles may pass through the bore around the shank during use of the tool.

2 Claims, 4 Drawing Figures

FIG. 1
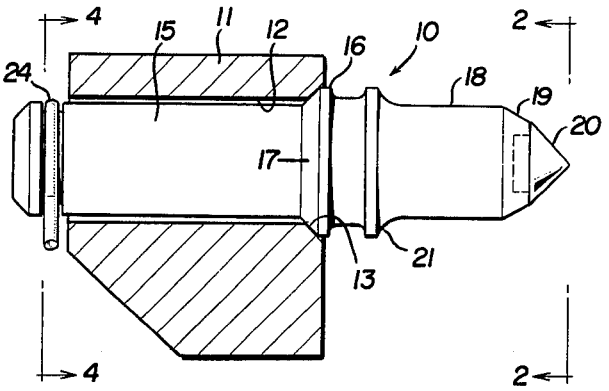
FIG. 2
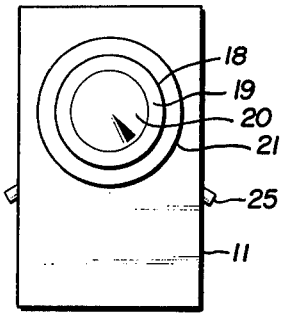
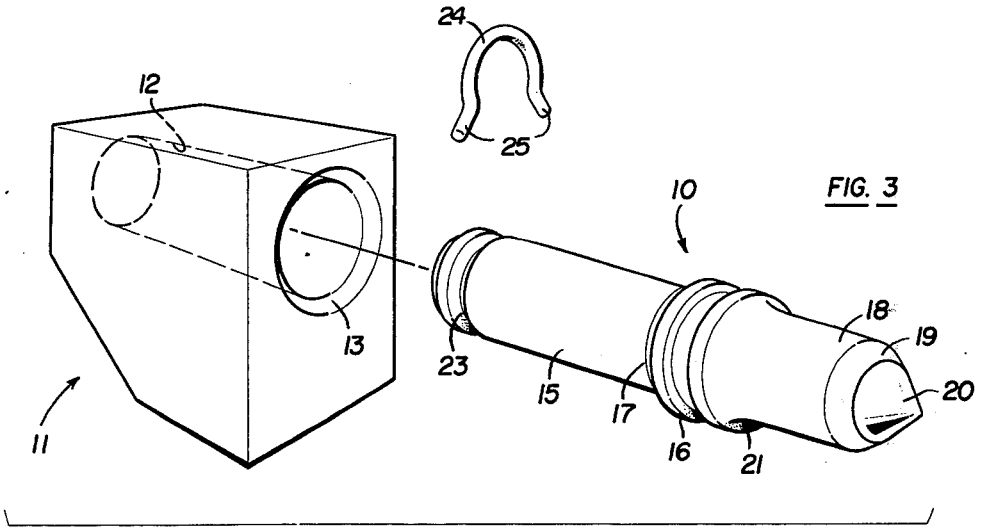
FIG. 3
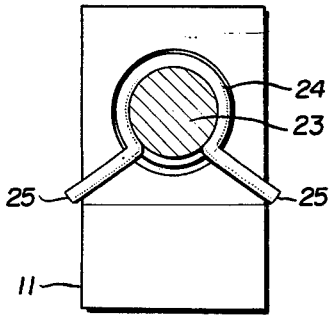
FIG. 4

ROUGH CUTTER MINING TOOL

BACKGROUND OF INVENTION

Conventional rotary mining tools generally comprise a lug or holder, mounted upon a rotary device or chain-like device, having a socket to receive a removable bit. The bit normally consists of shank portion for fitting within the lug socket, and a head portion provided with a hard, metal tip for cutting.

In some of such devices, the shank is mounted within the socket in such a way that the shank may rotate during operation of the tool for rotation of the tip point of contact with the rock, against which the tool is applied, to prevent excessive wear at any one point on the tip. However, in such cases, unless the bit shanks are kept constantly lubricated, small particles, such as dust and the like, tend to enter between the bit shank and the socket and ultimately jam one against the other to prevent further rotation. Thus, various configurations of bit and lug sockets and various methods have been tried to seal out the entry of dust or small particles.

Where the tool is used for drilling or cutting in areas in which there is considerable sand or sand-like particles, invariably, these particles work their way in between the shank and lug socket where they act as an abrasive to wear the surfaces of each and thereby shorten the bit life as well as the lug life and, at times, where they act to jam the shank against rotation. Thus, typically, where such type of cutters are used in sand or sand-like particle places, the bit life is substantially shortened due to excessive wear caused by such particles at the shank and also excessive wear upon small portions of the cutting tip due to inability to rotate the tip.

Thus, the invention herein relates to an improvement in such type of so-called rough cutter bits particularly useful in sand or sand-like particle areas. The purpose of this invention is essentially to reduce wear and/or jamming of the bit shank within the lug or holder by an approach which is the opposite to that normally followed, namely, by letting the particles freely pass through and around the shank and bore or socket, rather than trying to keep them out, as is conventional.

SUMMARY OF INVENTION

The invention herein contemplates forming a rough cutter rotary mining tool with a lug or holder having an open-ended, straight-through cylindrical bore, to receive and support the shank of a removable cutter bit. The shank is essentially of uniform cylindrical shape of a diameter considerably smaller than the diameter of the bore and of a length greater than the length of the bore. An integral annular ring-like shoulder is formed at the forward end of the shank, i.e., where the head of the bit begins, for engagement with the lug, and the opposite end of the shank is provided with a removable retainer clip, with the distances between the shoulder and clip being sufficient to permit axially endwise movement of the shank relative to the bore.

Preferably, the ring-like shoulder is formed with a tapered portion for partially fitting within the bore open end and thereby centering the shank relative to the bore in response to axial force components resulting from the pressure of cutting applied to the tip of the bit.

Due to the differences in diameters of the shank and bore, a considerable space is formed therebetween through which sand-like particles may pass, with the particles being assisted in their movement out of the bore by the endwise, sidewise and rotative movement of the shank within the bore during movement of the lug carrying device in the cutting operation.

During such movement of the cutting device, the bit ring-like shoulder bottoms against the lug in response to cutting pressures. Upon release of such pressure, the shank moves to a limited extent in response to the movement of the lug carrier thereby preventing the packing of particles within the bore and assisting in the removal of such particles automatically.

With such construction, the abrasive effect of such particles upon the shank and the bore surface is considerably reduced, thereby equally reducing wear on the surfaces. Moreover, since the bit is more freely rotatable, concentrated wear on any portion of its tip is reduced.

As contrasted with conventional and prior art cutter bit-lug mounting devices, wherein efforts have been made to snugly or closely fit and hold the bit within the lug socket and to seal out particles, the construction herein contemplates the opposite, namely, loose, freely movable fitting and support of the bit shank within the lug socket and the acceptance of and free passage of particles through the socket.

These and other objects and advantages of this invention will become apparent upon reading the following description, of which the attached drawings form a part.

DESCRIPTION OF DRAWINGS

FIG. 1 illustrates the improved cutter bit and lug assembled together, with the lug shown in cross-section.

FIG. 2 is a front end view taken in the direction of arrows 2—2 of FIG. 1.

FIG. 3 is a perspective disassembled view of the lug, cutter bit and retaining clip.

FIG. 4 is a rear end view taken in the direction of arrows 4—4 of FIG. 1.

DETAILED DESCRIPTION

The rough cutter mining tool herein includes a rough cutter bit 10 mounted within a lug or holder or support 11 having a bit receiving socket or bore 12 extending completely through the lug and of straight cylindrical shape. Preferably the forward open end of the bore is provided with a tapered countersink 13.

The cutter bit is formed with an elongated, cylindrically shaped, uniform diameter shank portion 15 upon which is integrally formed a ring-like annular collar 16 having a rearwardly sloped shoulder surface 17 for cooperative engagement with the countersink 13. The cutter bit also includes an integral head portion 18 whose forward end 19 is tapered and provided with a hard insert, such as carbide or the like, cutter point 20 secured thereto in any conventional manner, such as by brazing within the forward end 19. One or more integral ring-like guard formations 21 may also be formed upon the cutter bit near the rear end of the head portion.

The shank 15 is normally inserted into the lug bore 12 with the free end of the shank extending rearwardly out of the bore. To retain the shank within the bore, an annular groove 23 is formed in the shank free or rear end and a retaining clip 24 is inserted in the groove. Such clip may be formed of a springy piece of wire bent into an approximately U-shape or partial ring shape with its opposite ends bent radially outwardly to form legs 25. As is illustrated in FIG. 1, the distance between the shoulder 17 and the retaining clip 24 is such that the shank may move endwise within the socket to a limited extent. That is, upon the application of cutting forces to the tip 20, the bit shoulder bottoms against the countersink 13 of the bore and the retaining clip 24 is spaced a short distance rearwardly of the rear end of the bore. Upon release of such rearward pressure upon the bit, the bit is free to slide forwardly until the retaining clip 24 engages the rear surface of the lug to restrain further forward movement of the bit.

The tapered shoulder portion 17 tends to self center the bit within the bore. The bit is of a considerably smaller diameter than the bore so that normally there is a space between the shank surface and the bore surface which space permits the shank to freely rotate within the bore as well as to move sidewise within the bore to a limited extent. Likewise, the space permits the movement of sand-like particles through the bore from one end to the other with the movement of such particles facilitated by the endwise, sidewise and rotative movements of the shank relative to the bore during operation of the cutting tool. While the space may be varied in dimension to perform the forgoing function, an example of an acceptable spacing is .015 inches provided by a shank of 0.735 inches in diameter filled with a bore of 0.750 inches diameter.

When the bit cutting tip 20 becomes worn, as it will inevitably, the bit can be removed from the lug by prying the retaining clip out of the groove 23 and then simply grasping and pulling the bit forwardly out of the socket or bore of the lug. A new bit can then be slid rearwardly into the bore and the clip reapplied for rapid interchangeability of bits.

Having fully described an operative embodiment of this invention, I now claim:

1. A rotary mining tool comprising:

a unitary bit support lug consisting of a metal block having a substantially planar forward face and terminating in a substantially planar rear face, there being no block support structure extending beyond the rear face, an open ended cylindrically shaped bore extending through the lug from the forward face to the rear face, with the open bore ends forming forward and rear end portions, said forward end portion including a forwardly facing tapered countersink;

a cutter bit formed of an elongated, cylindrically shaped shank portion and an elongated head portion, with an integral annular ring-like shoulder formed on the bit between the shank and head portions, the shoulder having a rearwardly facing tapered surface substantially conjugate with the tapered countersink;

a cutter point secured on the terminal end portion of the elongated head of the bit;

the shank portion being loosely fitted within the lug bore with the tapered shoulder normally engaging the tapered countersink for centering the bit relative to the bore and with the cutter head portion extending forwardly of the bore forward end portion, and with the free end of the shank portion extending rearwardly beyond the bore rear end portion and the terminal rear face of the unitary lug;

non-biasing retaining means including a clip mounted in an annular groove formed in the free end of the shank portion for engaging the lug at the bore rear end portion, said clip being comprised of a springy wire bent into an open ring-like, roughly U-shaped form, frictionally fitted within said annular groove with the wire extending radially outwardly of the groove for engaging the lug at the bore rear end portion, and with opposite ends of said wire being bent into legs extending approximately radially outwardly of the shank for engaging the lug portion adjacent to the wire wherein the wire may be removed for removing the shank portion forwardly endwise of the bore for replacement of the cutter bit, said annular groove being only slightly larger than the clip so that the clip will be accurately positioned, with the distance between the groove and forward-most portion of the ring-like shoulder being greater, but only slightly greater, than the distance between the forward and rear lug faces to permit limited unrestricted axial endwise movement of the shank portion relative to the bore, the retaining means being normally spaced a short distance rearwardly of the bore rear end portion and the lug rear face;

the shank portion being of a considerably smaller diameter than the bore diameter wherein the surface of the shank portion is normally spaced from the bore surface and the shank portion may freely rotate within and may move sidewise relative to the bore, and said shank having a continuous, uninterrupted cylindrical surface between the groove and the tapered shoulder and further, the ratio of: (A) the difference between the diameter of the bore and the diameter of the shank to (B) the diameter of the bore, being substantially about 1:50;

wherein small sand-like particles entering the bore forward end portion will pass between the adjacent cylindrical shank and bore surfaces and out of the bore rear end portion around the non-biasing retaining means, with such passage facilitated by unbiased relative movement between the shank portion and bore resulting from disengagement of the tapered surfaces of the shank shoulder and the lug countersink as limited by the clip retaining means engaging the lug rear face.

2. A construction as defined in claim 1, wherein the shank further includes an integral, annular, ring-like guard protrusion formed on the head portion thereof for directing foreign particles and cuttings away from the lug bore.

* * * * *